US008528243B1

(12) United States Patent
Glock

(10) Patent No.: US 8,528,243 B1
(45) Date of Patent: Sep. 10, 2013

(54) PISTOLS AND METHODS OF MANUFACTURE

(76) Inventor: Gaston Glock, Velden am Woerthersee (AT)

( * ) Notice: Subject to any disclaimer, the term of this patent is extended or adjusted under 35 U.S.C. 154(b) by 0 days.

(21) Appl. No.: 13/545,399

(22) Filed: Jul. 10, 2012

(51) Int. Cl.
*F41C 23/10* (2006.01)

(52) U.S. Cl.
USPC ..... 42/75.02

(58) Field of Classification Search
USPC ..... 42/76.01, 77, 71.02, 14; 89/29
See application file for complete search history.

(56) References Cited

U.S. PATENT DOCUMENTS 4,459,774 A * 7/1984 Ferretti ..... 42/77
5,563,362 A * 10/1996 York ..... 89/14.3
5,669,169 A * 9/1997 Schmitter et al. ..... 42/75.01
6,112,636 A * 9/2000 Besselink ..... 89/191.01
6,260,301 B1 * 7/2001 Aigner et al. ..... 42/71.02
6,401,379 B1 * 6/2002 Moon ..... 42/71.02
6,694,658 B1 * 2/2004 Marsac ..... 42/54
7,121,035 B2 * 10/2006 Greer ..... 42/77
7,694,449 B1 * 4/2010 Pontillo, II ..... 42/71.02
2005/0028421 A1 * 2/2005 Saxby et al. ..... 42/77

* cited by examiner

*Primary Examiner* — Michael Carone
*Assistant Examiner* — Reginald Tillman, Jr.
(74) *Attorney, Agent, or Firm* — Thomas | Horstemeyer, LLP

(57) ABSTRACT

Pistols and methods of manufacture are provided. A representative pistol includes a slide, at least part of the slide being made of plastic; wherein the pistol is a small caliber pistol or pistol for low-impulse ammunition or training pistol. A representative method for manufacturing a pistol includes: forming a slide of the pistol, with at least part of the slide being made of plastic; wherein the pistol is a small caliber pistol or pistol for low-impulse ammunition or training pistol.

20 Claims, 4 Drawing Sheets

PISTOLS AND METHODS OF MANUFACTURE

CROSS-REFERENCE TO RELATED APPLICATION

This application is a co-pending application which claims priority to Austrian Application No. A520/2012, filed Apr. 30, 2012, which is incorporated by reference herein in its entirety.

TECHNICAL FIELD

The invention relates to a small caliber pistol, a pistol for low-impulse ammunition (e.g. 0.22 LR or 0.380 auto/9 mm short) or a training pistol.

DESCRIPTION OF THE RELATED ART

In general and specifically with respect to the application at hand, a training pistol or small caliber pistol or a pistol for low-impulse ammunition refers to pistols which resemble traditional pistols as closely as possible in terms of appearance, exterior dimensions and handling, but which are only suitable for use with low-impulse ammunition or training ammunition (blank cartridges, color marking cartridges, rubber bullets) because of altered breech components, barrels, magazines, etc. The reason for these efforts is the increased safety associated with training ammunition and the lower costs for low-impulse ammunition.

These types of designs are not only known for pistols; in fact, the Austrian Federal Armed Forces used a similar device for the Belgian-produced STG-58, said Belgian original being referred to as FN FAL. This weapon was available with the so-called K-device and after putting (screwing) it on, it was possible to fire blank cartridges, because with the virtually complete coverage of the mouth of the barrel even blank cartridges containing only a minimum amount of gun powder generated a sufficient amount of pressure to enable the automatic charge. In connection with this approach, it was and is extremely problematic that the K-device is optically inconspicuous, thus inevitably resulting in the destruction of the weapon and injury of the shooter when traditional ammunition is fired through the screwed-on K-device.

The barrel and slide of the aforementioned pistols are made of aluminum, while the regular material, usually steel, is left in place for the traditional handle parts. As a result of the mass reduction induced by the moveable parts, it is also possible for the propellants to sufficiently move the slide even when using low-impulse training ammunition, for example 9 mm FX in a weapon normally used with 9 mm ammunition, in order to push out the cartridge shell and pull the next cartridge into the breech.

From a technical point of view, the major issue is that the used moveable parts made of aluminum display a completely different thermal expansion behavior than the handle part of the weapon and the slide parts normally made of steel, resulting in problems especially in connection with longer exercises during which a greater number of shots are fired. Finally, the entire tribological behavior of aluminum in contact with the steel of the guides in the handle piece is extremely problematic and unforeseeable and results in a host of troubles.

The purpose and objective of the invention is to solve these problems and to create an exercise weapon in which as few parts as possible are different from those of the original weapon, in which the handling and the feel associated with the use of the weapon in training mode resemble the use of the original weapon as closely as possible in case of an emergency, in which the safety aspects are ensured the best they can possibly be, and which is in line with the prior art from an economical point of view.

BRIEF DESCRIPTION OF THE DRAWINGS

The invention is explained in more detail below based on the drawing. In the figure(s).

DETAILED DESCRIPTION OF EXAMPLE EMBODIMENTS

The or a part of the slide that forms the barrel sheath and/or the or a part of the slide that forms the outer cover of the firing mechanism is not made of metal but of plastic, while the remaining part that carries or forms the guides and is in contact with the handle part includes regular steel in these types of pistols. The manufacture can either be realized by inserting the remaining residual metal slide in the fashion of a lost core into a matching mold of an injection molding machine or by customized injection molding of the plastic cover parts with correspondingly designed slot-spring connector elements both on the residual slide as well as the plastic parts. Adhesive joints are also an option.

In one embodiment, it is intended to design the barrel in a suitable shape for low-impulse ammunition and to fill the free volume remaining between the training barrel and the regular barrel with plastic, preferably by way of extrusion-coating the training barrel with an injection molding machine. In the process, the barrel is preferably arranged off-center or diagonal to the regular barrel axis, such that the trajectory of the low-impulse projectile coincides to the greatest possible extent with an imaginary trajectory of the projectile of the original weapon within the intended distance.

On the one hand, the measures achieve an excellent mass reduction of the moveable parts of the weapon, ensuring its full functionality in connection with the use of low-impulse ammunition while, on the other hand, any problems associated with the kinetic friction between steel and aluminum are prevented and finally, the plastic, preferably featuring a suitable color, achieves a highly visible optical cue to the effect that this concerns, e.g., a training weapon which may only be used with training ammunition or a low-impulse weapon with a caliber of e.g. 0.22 LR or 0.380 auto/9 mm short. In so doing, it is possible to use different colors to indicate different types of permitted ammunition.

Figure 1:
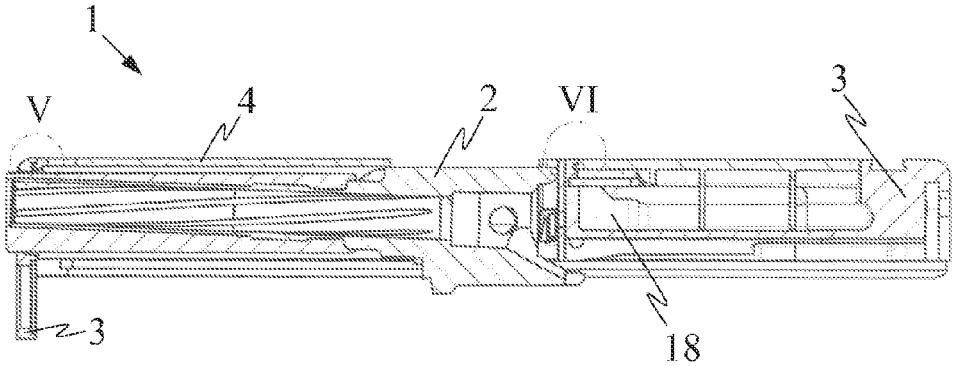
FIG. 1 shows a breech according to the invention including the barrel in the section I-I of FIG. 3, FIGS. 2 to 4 show side views and a top view of the breech.
Figure 2:
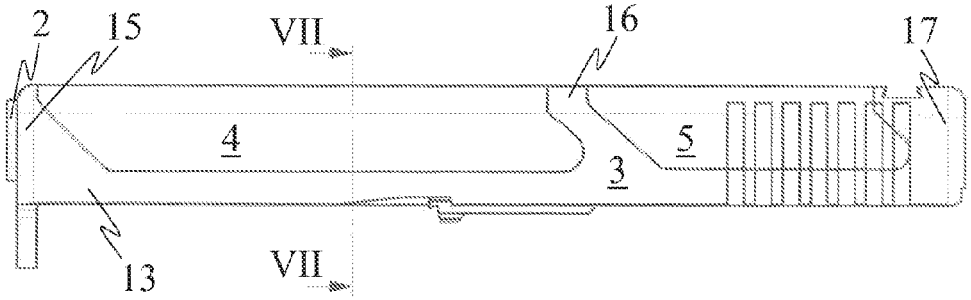
Figure 3:
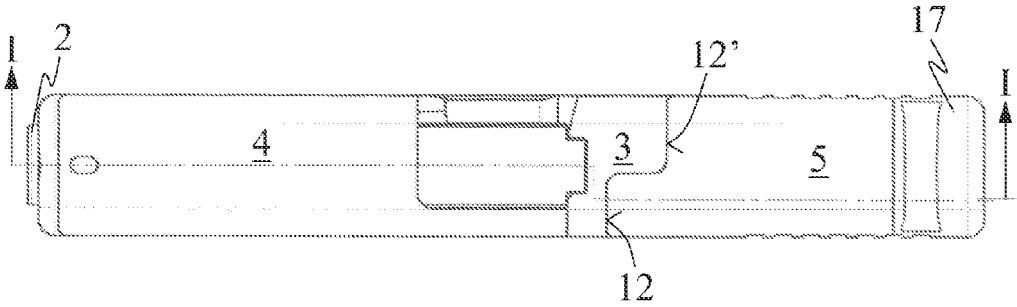

FIG. 1 illustrates a cross section of the slide or breech 1 designed which corresponds to the plane through section I-I in FIG. 3, hence along the plane of symmetry in the barrel area and parallel to the plane of symmetry in the firing pin area. The barrel part 2 in locked position is also illustrated. The slide 1 comprises a steel frame 3 which is brought into an exterior shape illustrated in FIG. 2 by means of a plastic part 4 provided in the area of the barrel cover and a plastic slide cover 5 in the area of the firing mechanism, and said shape is not deviating from a traditional pistol with respect to its outline.

As seen in FIGS. 1 to 4, the slide 3 or the residual metal slide 3 is reduced to two longitudinal bars 13, 14, said bars extending along the entire length on the left and right side, just underneath the barrel in the direction of the barrel axis and they are essentially connected with the arc-shaped connector elements in three positions: in the area of the barrel opening and an outlet arc 15, which also extends to below the guide plane of the slide 1 where it forms the abutment for the recuperating spring; behind the breech in a breech arc 16 and at the end of the breech 1 in a terminal arc 17. In addition, the guide for the striking pin and the firing spring is designed in the region of the firing mechanism, nearly in the middle behind the barrel; this part 18 also connects the two longitudinal bars.

The figures and description illustrate that essential parts of the slide are made of plastic and that the respective mass reduction ensures the proper operation of pistols even with low-impulse ammunition.

Figure 5:
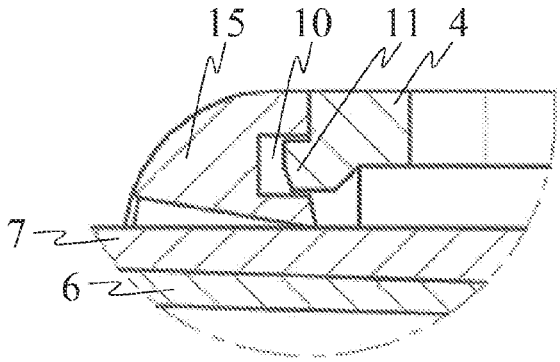
FIG. 5 shows the detail V of FIG. 1.
Figure 10:
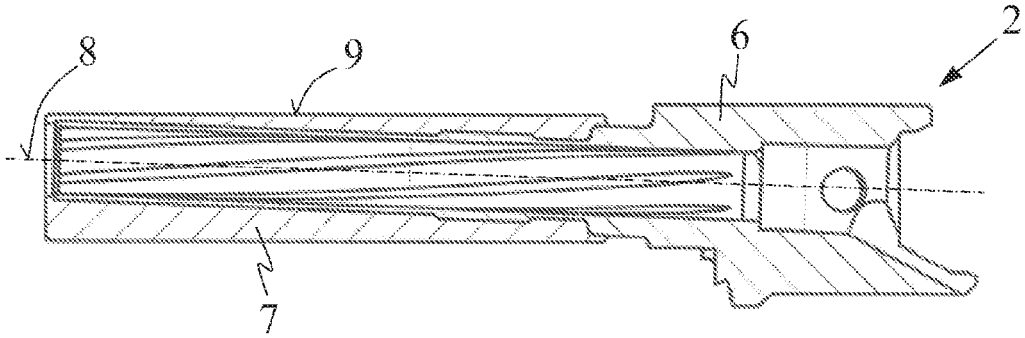
FIG. 10 shows a cross section of the barrel part.

For the use of small caliber ammunition mentioned above fired from weapons which are actually intended for larger calibers with respect to the handle piece and the exterior dimensions of the breech, the design of a barrel as illustrated in FIG. 5 is proposed in an advantageous embodiment in a systematic upgrade of the inventive idea. The barrel part 2 includes a basic part 6 made of commonly used steel and a plastic barrel 7 enveloping the largest part. As clearly seen in FIG. 10 illustrating a cross section through the axis of symmetry of the barrel piece 2, the barrel axis 8 is tilted compared to the top most generatrix or outlining edge 9 of the barrel envelope 7, whose exterior contours correspond to the contour of the barrel part when using traditional ammunition and traditional calibers. This means that the barrel part 2 corresponds to an "original" barrel part in terms of its exterior dimensions and its appearance, except for the fact that the plastic material has a clearly different visual appearance than the metal, while the arrangement of the barrel axis 8 and the design of the breech with a correspondingly smaller caliber is nevertheless possible.

The inclination between the barrel axis 8 and the parallel straight lines 9 relative to the "regular" barrel axis ensures that the fired bullet intersects the normal trajectory of a regular caliber weapon in the target area again with shorter training distances (e.g., 10 meters for pistols) and identical use and therefore the handling of the training weapon or a weapon with low-impulse ammunition also corresponds to the handling of a regular weapon.

As briefly mentioned above, the plastic parts around the metal parts can be molded in the fashion of lost cores; alternatively, they can be manufactured separately by attaching corresponding holder elements on the metal residues of the breech 3 and the barrel 6 in order to build the breech.

FIGS. 5 to 9 illustrate how these elements are designed in a preferred embodiment:

FIG. 5 shows the detail V of FIG. 1 in the area of the front arc 15 of the residual metal breech 3: this barrel arc 15 has a groove-shaped or pocket hole-like recess 10 on its abutting surface pointing back toward the breech, with the front abutting surface of the plastic barrel cover resting on said abutting surface, and with a ridge-shaped or hat-shaped projection 11, originating from the abutting surface of the barrel cover 4, extending into said recess and preferably snapping in under light prestress (compression).

If the recess 10 is designed groove-shaped and hence the projection 11 is designed ridge-shaped, these two elements essentially extend across almost the entire area of the inner width of the residual breech 3. If the front bracket 15 in the direction of the barrel axis is designed particularly thin so that almost no substance remains in the top most area above the highest generatrix of the barrel part 2, it is advantageous to provide two shorter or pot-like recesses on the left and right of the middle plane instead of the groove-shaped recess 10 and to adjust the shape and dimension of the recess or recesses 11 accordingly.

Figure 6:
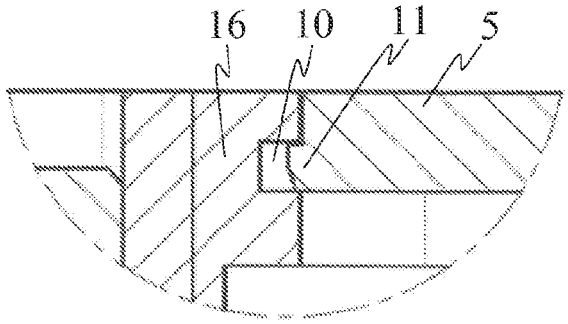
FIG. 6 shows the detail VI of FIG. 1.

FIG. 6 shows the detail VI of FIG. 1, hence if looking at the top view of the slide according to FIG. 3, it shows area 12. As seen in FIG. 6, the same procedure as for the barrel arc 15 was implemented in the region of the breech arc 16, except that here, because of the offset of the transverse pitch into sections 12 and 12' (FIG. 3), it is innately necessary to bisect both the recess 10 as well as the projection 11. Whether they subsequently have a more groove-shaped or a more pot-shaped design and are possibly divided once more is a question the designer will easily be able to answer based on the design criteria available to him/her and the advantages or disadvantages associated with the manufacture of the shapes for the plastic part and the incorporation of the recesses into the metal part.

Figure 7:
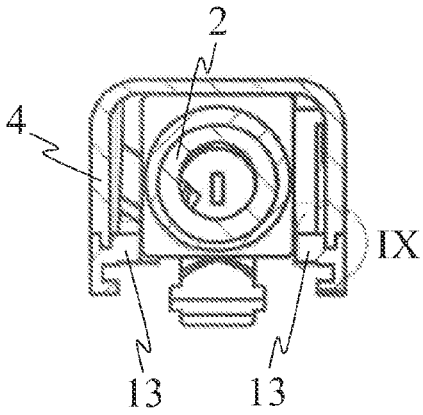
FIG. 7 shows the section VII-VII of FIG. 2.

FIG. 7 shows section VII-VII of FIG. 2 normal relative to the axis of the weapon, which would also be normal relative to the barrel axis 8 with a "regular" design, but which is considered normal relative to the generatrix 9 (FIG. 10) in this case. As seen in this figure, the barrel cover 4 made of plastic forms the largest part of the breech surface and the sheathing in this large area of the breech, while the metal residue 3 of the slide in this area is reduced to the two longitudinal bars 13 with a small cross section, said cross section forming the guides (without reference numbers) arranged in the lower area for the counterstays on the handle piece and comprising longitudinal grooves on the side facing the plastic, said longitudinal grooves being clearly visible in FIG. 9 which once again shows the enlarged detail IX of FIG. 7: a ridge-shaped projection 11 of the barrel cover 4 made of plastic projects into said grooves 10.

Figure 4:
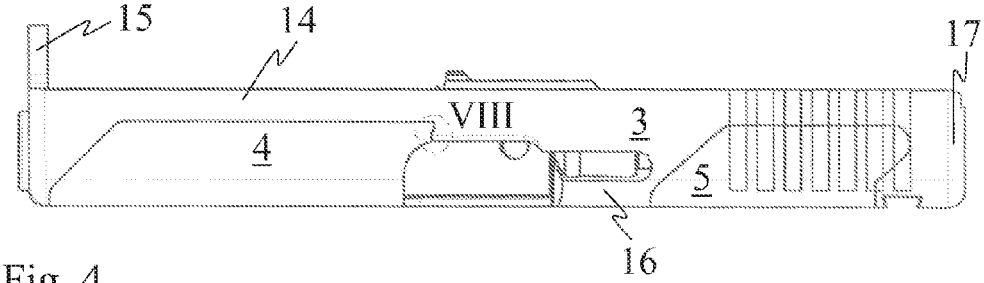
Figure 8:
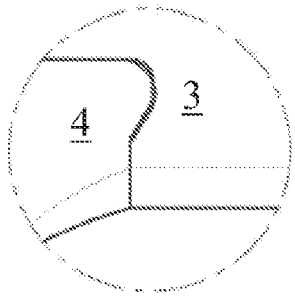
FIG. 8 shows the detail VIII of FIG. 4.
Figure 9:
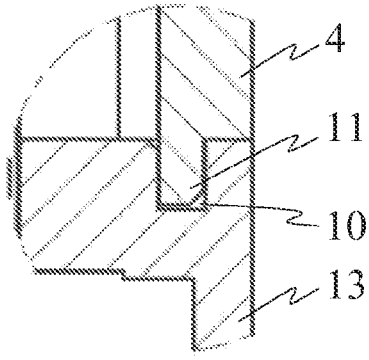
FIG. 9 shows the detail IX of FIG. 7.

FIG. 8 illustrates the detail VIII of FIG. 4. It is the back end of the right bar 13 (always relative to the normal hold of the weapon while in use) and comprises an undercut for retaining the plastic part 4 in the residual metal breech 3, with a bulge of the plastic part inserted into said undercut and hence absorbing longitudinal forces on this side of the cover part 4 without being able to break away.

Figure 11:
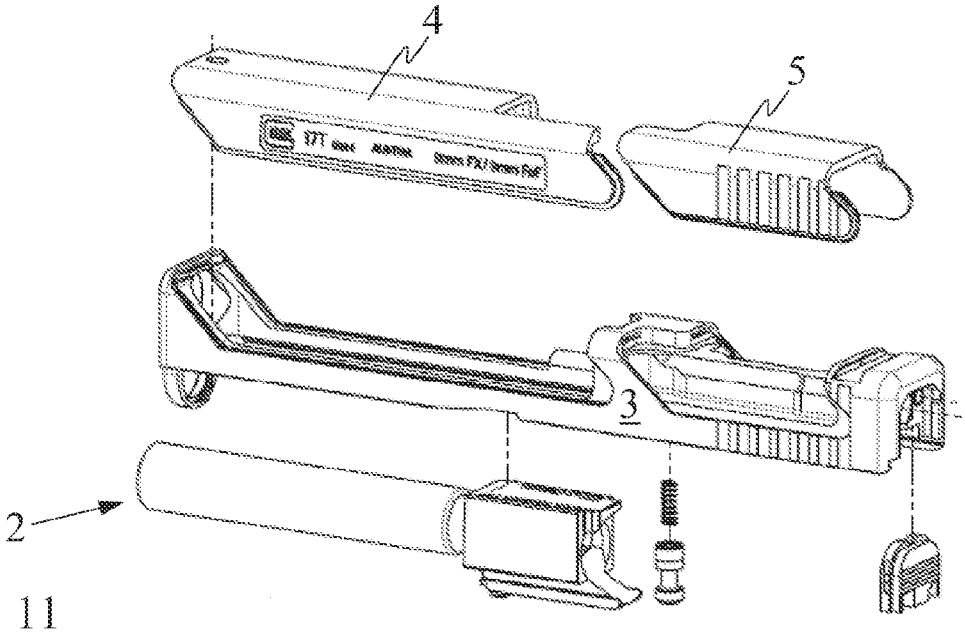
FIG. 11 shows an exploded sketch in perspective and FIG. 12 shows a perspective representation of an entire weapon.

Finally, FIG. 11 shows a kind of vertical exploded sketch of the two cover parts 4 and 5 made of plastic, the residual slide 3 made of metal and the assembled barrel part 2 underneath, whereby the shoulder of the plastic sheath surrounding the metal barrel is clearly visible for the barrel part 2. Other components of the pistol relating to a striking pin safety mechanism and a back cover of the slide 3 are also illustrated in FIG. 11; however, they are not associated with the invention and are therefore not labeled with reference numbers.

Figure 12:
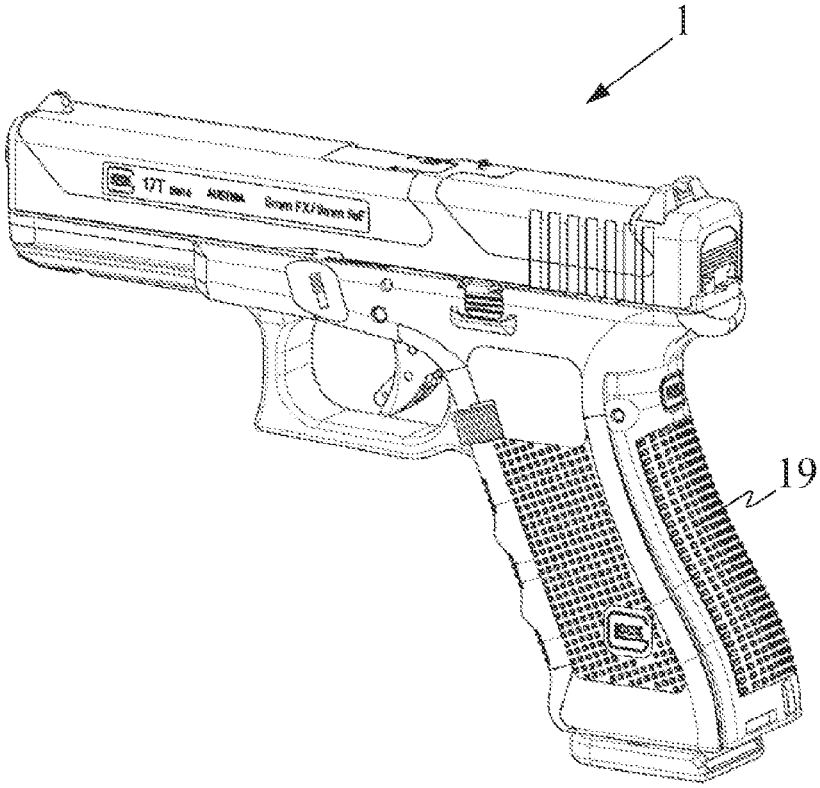

Finally, for the sake of completeness, these parts are illustrated in normal, assembled condition placed on a handle part 19 in FIG. 12.

The invention is not restricted to the illustrated exemplary embodiment, but it can be modified in different ways. For instance, the plastic parts and the residual metal slide can be connected differently, for example by way of gluing, and the size of the areas of the covers of the slide replaced with plastic can vary, especially with respect to the different designs of known pistols, which comprise different mass distributions between the breech, guide area of the slide, cover of the barrel and breech, etc.

The only essential condition is that the parts of the "original" slide, which are used as guides, as an impact base, as contact areas in the region of the breech or as contact elements in the region of the ejection port for whatever components or projectile parts, are still made of metal and must have a sufficient amount of substance to ensure the mechanical stability.

It is obviously necessary to always base the different applications on the specific weapon for which a training weapon is to be created. This special normal weapon is used to define the area of the slide to be replaced with plastic in order to achieve the mass reduction which a person skilled in the art can easily calculate with the knowledge of the selected training ammunition. Said area of the slide is subsequently defined based on the criteria: reduction where the guide on the handle piece is not impaired and in such a way that the mechanical stability of the slide is not impaired.

Any plastic can be used which is capable of withstanding the expected thermal and mechanical exposures. The growing use of plastic for firearms in recent years provides the person skilled in the art with a host of potential plastics, including PA66 as an example.

The invention claimed is:

1. A pistol, comprising:

a slide, at least part of the slide being made of plastic;

wherein the pistol is a small caliber pistol or pistol for low-impulse ammunition or training pistol;

wherein the slide has a residual frame and a cover part, the residual frame being made of metal, the cover part being made of plastic; and wherein the residual frame has a left side longitudinal bar and a right side longitudinal bar, each of which extends along an entire length of the slide;

wherein the left side longitudinal bar and the right side longitudinal bar are connected with arc-shaped connector elements.

2. The pistol of claim 1, wherein the cover part is connected with the residual frame by groove-spring connections.

3. The pistol of claim 1, wherein the cover part is connected with the residual frame by snap-in connections.

4. The pistol of claim 1, wherein the slide exhibits exterior dimensions corresponding to dimensions applicable to a regular pistol for high-impulse ammunition.

5. The pistol of claim 1, wherein:

the pistol defines a barrel axis; and the barrel axis is arranged at an incline with respect to a longitudinal axis of the slide.

6. The pistol of claim 1, wherein:

the pistol further comprises a barrel; and the cover part is positioned to form a sheath for the barrel.

7. The pistol of claim 1, wherein:

the pistol further comprises a firing mechanism; and the cover part is positioned to form an outer cover of the firing mechanism.

8. The pistol of claim 1, wherein:

the pistol further comprises a barrel and a firing mechanism;

the cover part of the slide is positioned to form a sheath for the barrel; and the slide has an additional cover part being made of plastic and being positioned to form an outer cover of the firing mechanism.

9. The pistol of claim 1, wherein the metal comprises steel material.

10. The pistol of claim 1, wherein the plastic comprises PA66 material.

11. The pistol of claim 1, further comprising a handle part connected to the slide.

12. A slide for a pistol comprising:

a residual frame made of metal; and a cover part made of plastic;

wherein the residual frame has a left side longitudinal bar and a right side longitudinal bar, each of which extends along an entire length of the slide wherein the left side longitudinal bar and the right side longitudinal bar are connected with arc-shaped connector elements.

13. The slide of claim 12, wherein the cover part is connected with the residual frame by groove-spring connections.

14. The slide of claim 12, wherein the cover part is connected with the residual frame by snap-in connections.

15. The slide of claim 12, wherein the slide exhibits exterior dimensions corresponding to dimensions applicable to a regular pistol for high-impulse ammunition.

16. The slide of claim 15, wherein the cover part is positioned to form a sheath for a barrel of the pistol.

17. The slide of claim 16, wherein the slide has an additional cover part made of plastic that is positioned to form an outer cover of a firing mechanism of the pistol.

18. The slide of claim 12, wherein the metal comprises steel material.

19. The slide of claim 12, wherein the plastic comprises PA66 material.

20. The slide of claim 12, wherein cross sections of the left side longitudinal bar and the right side longitudinal bar form guides for connecting with a handle part of the pistol.

* * * * *